United States Patent [19]

Alvarez-Calderon F.

[11] 3,937,025

[45] Feb. 10, 1976

[54] INFLATABLE ENVELOPE SYSTEMS FOR USE IN EXCAVATIONS

[76] Inventor: Alberto M. Alvarez-Calderon F., 512 E. Central St., Santa Maria, Calif. 93454

[22] Filed: May 2, 1973

[21] Appl. No.: 356,591

[52] U.S. Cl. ..... 61/35; 61/45 R; 299/11

[51] Int. Cl.[2] ..... E02D 5/00

[58] Field of Search ..... 61/45 D, 35, 36, 63; 299/11

[56] References Cited

FOREIGN PATENTS OR APPLICATIONS

| | | | |
|---|---|---|---|
| 1,008,534 | 5/1952 | France | 299/11 |
| 1,003,675 | 3/1957 | Germany | 61/45 D |
| 1,069,549 | 11/1959 | Germany | 299/11 |
| 1,108,160 | 6/1961 | Germany | 299/11 |
| 1,252,161 | 10/1967 | Germany | 61/45 D |

*Primary Examiner*—Dennis L. Taylor
*Attorney, Agent, or Firm*—Flehr, Hohbach, Test, Albritton & Herbert

[57] ABSTRACT

This invention pertains to inflatable envelope apparatus or pressurized container structures and associated methods to be used together with slurry products of concentrated or metallurgical plants in backfilling and other operations involving subterranean works. The pressurized container structures are envelopes which can be fabricated of various materials and shapes, or other light weight pressurized containers, the shape or volume of which is sustained by internal gas pressure. The technique for extracting a metal bearing substance comprises several steps, the principal ones being the placing within a subterranean chamber a pressurized envelope structure, pouring into the chamber adjacent the envelope structure slurry products emanating from a concentrator or flotation plant which lie in contact with but external to the pressurized envelope. The slurry is dewatered or otherwise solidified after which the metal bearing substances located adjacent to the envelope are extracted using equipment acting from within the volume defined by the envelope.

25 Claims, 35 Drawing Figures

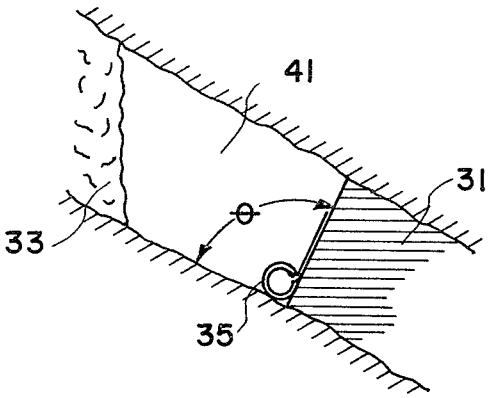
FIG.-7
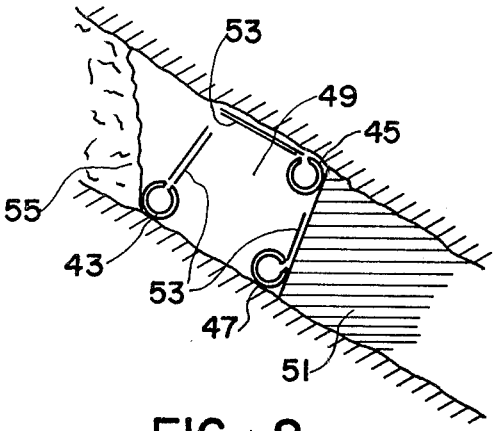
FIG.-8
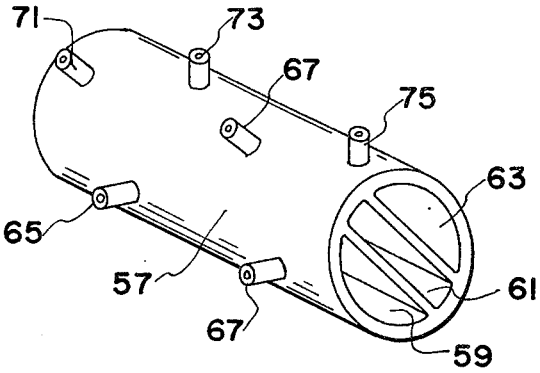
FIG.-9
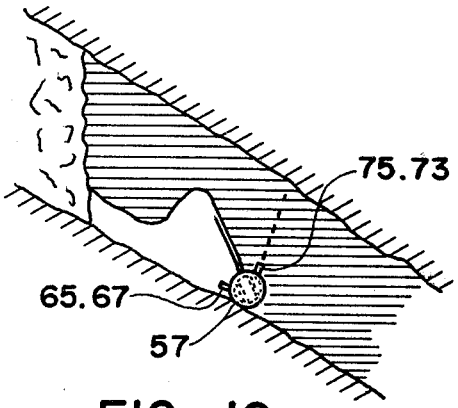
FIG.-10
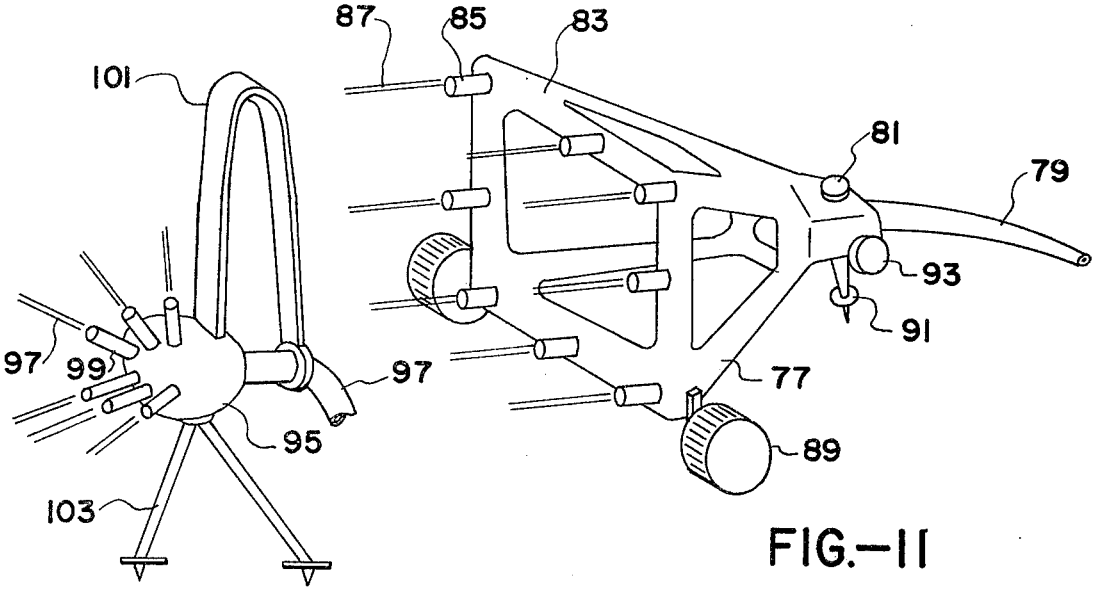
FIG.-11
FIG.-12

INFLATABLE ENVELOPE SYSTEMS FOR USE IN EXCAVATIONS

BACKGROUND OF THE INVENTION AND REVEIW OF PRIOR ART

In mining operations it is often necessary to handle slurry emanating from flotation or concentrator platns in which ore produced in mines is treated.

One common instance is the use of tailings slurry from the flotation plant or other kinds of liquid-solids mixture to fill back the excavation chamber or stopes from which ore is extracted. For several decades it has been common practice to re-fill the excavation chamber wherefrom ore is extracted with common rocks, which act to support the roof of the excavation. This is obviously expensive and time consuming. In more recent procedures, the tailing of the plant, which contains unrecoverable residual metals in the fluid, is pumped back into the mine's excavation. In the case of underground operations the tailings usually fill the exploitation chamber and once its liquid content has drained, it solidifies into a substance capable of supporting the roof. This procedure is known as backfilling with tails, and when practiced in shallow or horizontal ore bodies, requires the underground fabrication of frontal walls or dams within the compass of the chamber to force the position of the backfill against the chamber's roof and to separate the backfill from the ore face which is to be cut after the fill is dry. The span of unsupported roof between ore face and backfill is reduced with the frontal dams. Backfilling is often used also to dispose of the tailings in an inconspicuous non-polluting place, often requiring the erection of expensive walls to limit the location of the backfill within the desired bounds.

In another common instance the products of concentrator plants must be transported from the plant's location to the refinery wherein the concentrated products are transformed into metals. It has been common practice for several decades that the slurry products or pulp of the concentration plant are first allowed or forced to dry, and thereafter transported in bulk or in sacks. This requires special loading any unloading procedures which are costly. More recently, the pulp from a concentrator plant is pumped as a fluid to a recipient chamber in a transporting vessel, which can be a boat, a tank-truck or a railroad tank car; wherein the fluid material by drainage or other ways is transformed into a solid. For unloading purposes however, once the vessel arrives to its destination, water jets are used to re-transform the solid into pulp which is then pumped to the refinery. This type of loading and unloading in slurry form avoids considerable handling charges, other costs, and time delays.

It is seen that the handling of fluids emanating from concentrator or flotation plants has become in recent times of considerable technical importance with vast economic consequence.

SUMMARY OF THE INVENTION AND OBJECTS

In general, it is an object of the present invention to provide a method and apparatus utilizing inflatable structures which will substitute for the aforementioned operations requiring the building of dams and the like.

Another object of the invention is to provide a method and apparatus of the above character which is particularly applicable to act as a wall divider, dam or internal passage within a subterranean chamber. The invention also has application in connection with mining industries and other industries to regulate gas pressure exterior of the envelope and to control ventilation, define safety walls for containing dangerous gases and for the control of water and other fluids or slurries in surface and underground excavations.

According to the present invention, slurry emanating from a concentrator plant is poured into subterranean chambers. Inflatable envelopes or containers formed of light-weight structures and supported by internal gas pressures are pre-placed within the chamber and defined gas filled volumes emplaced within the slurry which is subsequently backfilled adjacent the envelope. The slurry is allowed to set as by becoming deliquified and at a later time extractive procedures are applied from within the volume defined by the envelope to recover substances initially adjacent thereto.

In one embodiment the inflatable envelope is placed within a chamber formed from the mining of an ore body and adjacent to a free face of the ore body prior to backfilling the chamber with tailings. The inflated envelope defines a lateral wall for the backfill and acts as a frontal dam the volume of which forms a passage between the fill and the ore face. Once the tails have become set as by drying and dewatering into a substantially solidified mass the body of solidified tailings offers support for upper and lateral walls of the chamber as well as the storage for the tailings themselves. The passage created by the envelope provides access from which operators using conventional drills can mine subsequent cuts from the ore body and transport the resultant run of the mine to outside the chamber. The backfill can consist of tailings from flotation plants or other slurried solids such as water suspended sand.

In another embodiment, the inflatable envelope is preplaced within the chamber of a transport vessel into which the slurry pulp of a concentrator plant is poured and deliquified. The container defines a passage or cavity within the dry pulp from within which an adequate pulping agent or solvent, such as high pressure water jets can be rapidly applied to transform the dry pulp into slurry which is then easily pumped out of the vessel at destination.

Also disclosed herein are air bag containers having one or more longitudinal or tubular chambers, some of asymetrically strechable material and some with internal structurs for defining particular shapes. In one form, an envelope is disclosed which can be assembled in an underground location.

BRIEF DESCRIPTION OF THE DRAWINGS RELATING TO THE PRIOR ART

FIG. 1 in a cross sectional elevational view of conventional backfill in a vertical ore body.

FIGS. 5 through 7 are similar to FIG. 2 and show the use of a rotating high pressure water tube to carve a passage within solidified backfill.

FIG. 8 is a view similar to that of FIG. 2 showing an alternate hydraulic method for carving out a passage inside settled backfill including the use of fixed tubes with jets.

FIG. 9 is a sketch illustrating the construction of a tube suitable for carving passages in backfill.

FIG. 10 is a view similar to FIG. 2 and FIG. 8 illustrating the use of tube construction of FIG. 9 in carving a passage inside settled backfill.

FIGS. 11 and 12 show sketches of water drills used in carving passages in dried substances.

BRIEF DESCRIPTION OF THE DRAWINGS RELATING TO THE PRESENT INVENTION

Figure 13:
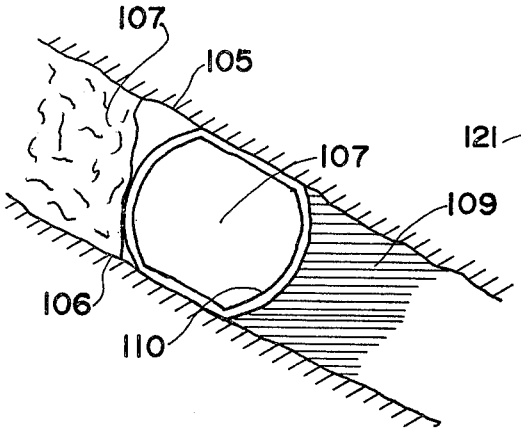

FIG. 13 shows a cross sectional elevational view of an inflated enclosure constructed in accordance with the present invention and installed in an inclined ore body.

Figure 14:
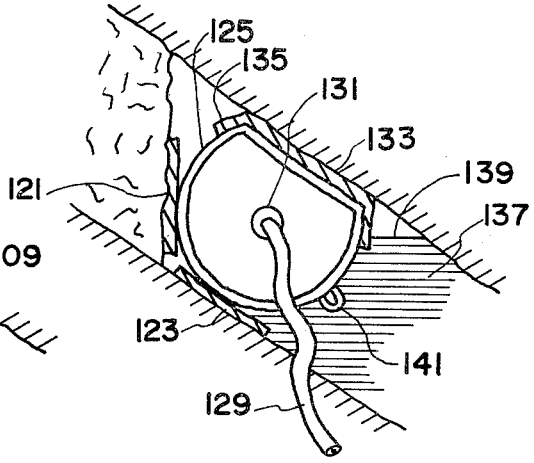

FIG. 14 is a view of an inflatable envelope constructed and used in accordance with the present invention and including means for permitting the envelope to be deflated and recovered after use.

Figure 15:
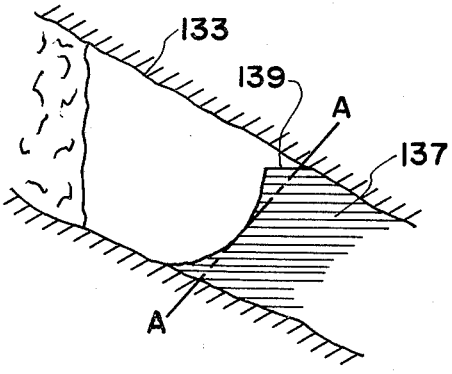

FIG. 15 illustrates the view similar to FIG. 13 and illustrates the nature of the passageway developed after deflation and removal of the envelope.

Figure 16:
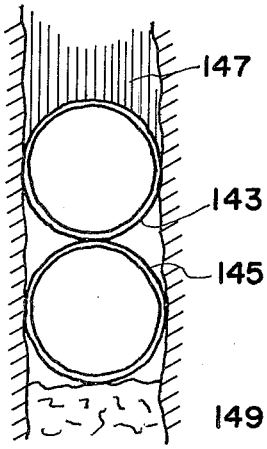

FIG. 16 is a top plan cross sectional view showing installation of inflatable envelopes in accordance with the present invention for use in a verticle shaft.

Figure 17:
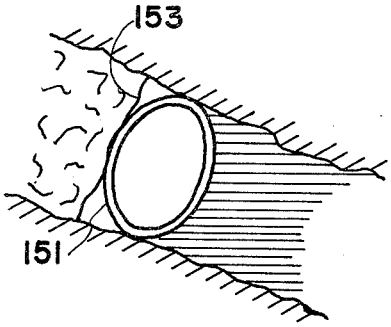
Figure 18:
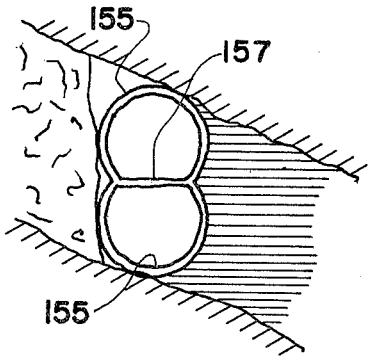

FIGS. 17 through 18 are views similar to FIG. 13 showing inflatable envelopes constructed in accordance with the present invention and having generally prolate shape in cross section.

Figure 19:
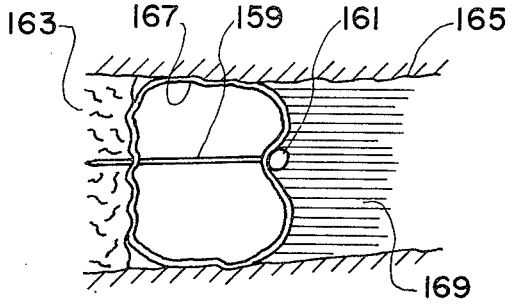
Figure 20:
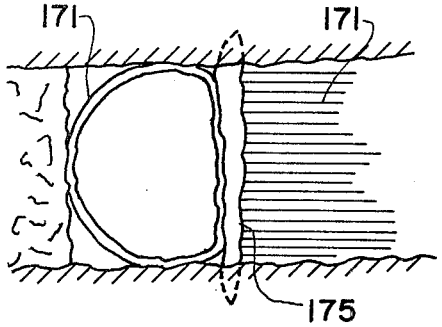

FIGS. 19 and 20 are cross sectional elevational views illustrating inflatable structures constructed in accordance with the present invention together with means for controlling the shape thereof.

Figure 21:
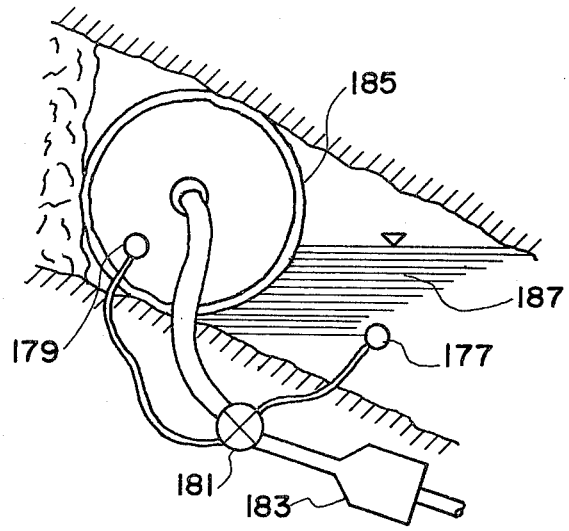

FIG. 21 is a cross sectional elevational view of inflatable envelope constructed in accordance with the present invention installed in an inclined stope and using pressure valves for regulation of the pressure within the envelope and the head of the backfill.

Figure 22:
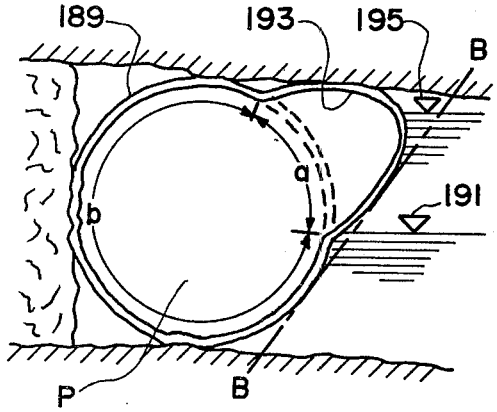
Figure 23:
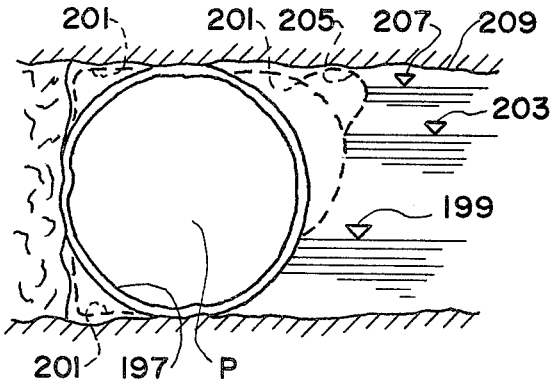
Figure 24:
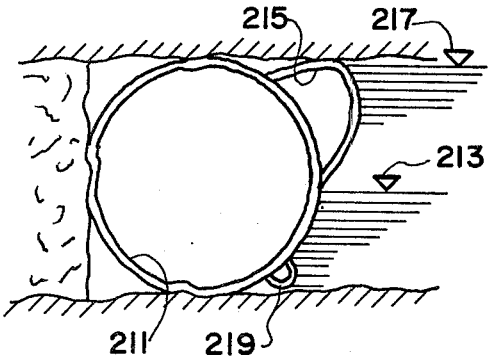

FIGS. 22 through 24 illustrate cross sectional elevational views various systems in accordance with the present invention for controlling the cross-sectional shape of the envelope.

Figure 25:
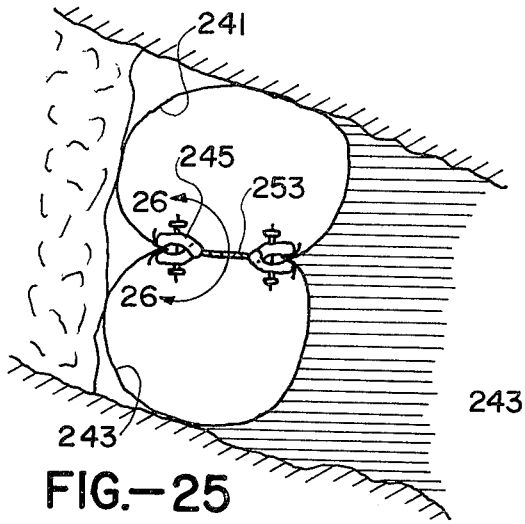

FIG. 25 is a cross sectional elevational view showing an enflatable envelope adapted for assembly in an underground location.

Figure 26:
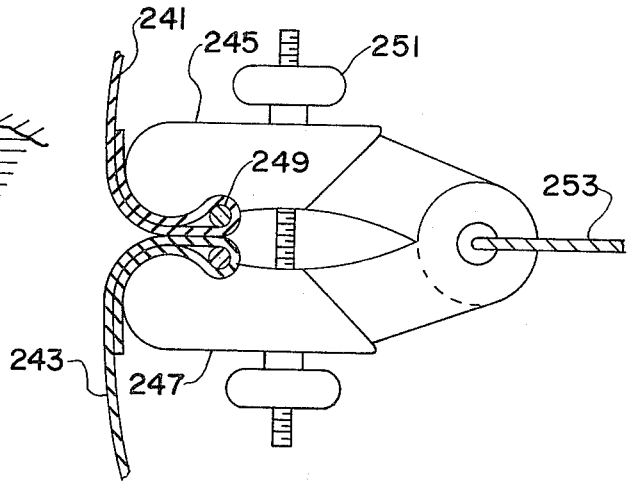

FIG. 26 is a detailed view taken along the lines 26—26 of FIG. 25.

Figure 27:
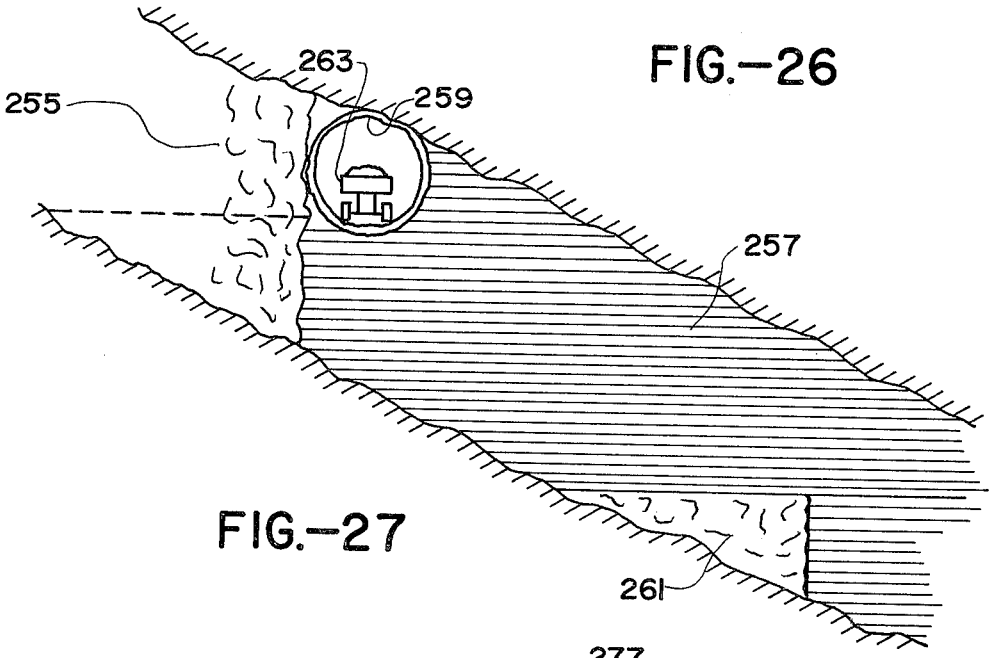

FIG. 27 is a cross sectional elevational view illustrating the positioning of an inflatable envelope in accordance with the present invention under flotation in an inclined underground stope.

Figure 28:
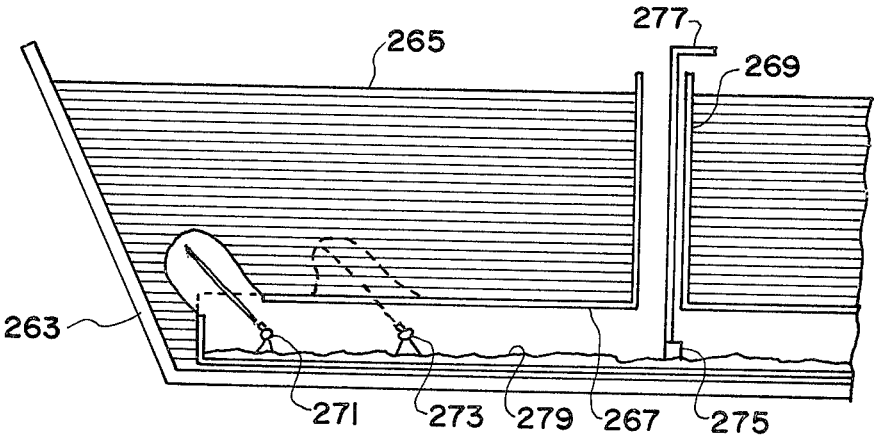
Figure 29:
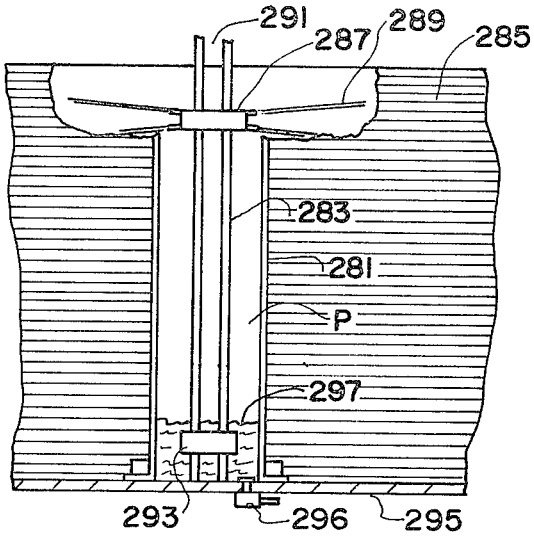
Figure 30:
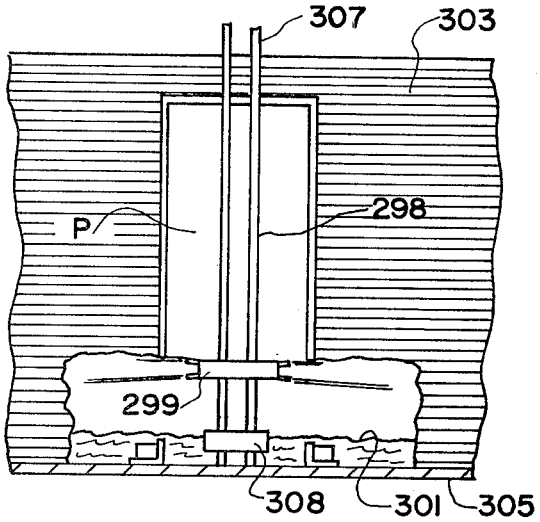

FIGS. 28, 29 and 30 are cross sectional elevational views showing the use of inflatable envelope structures in accordance with the present invention for the unloading of slurryable material from a vessel.

Figure 31:
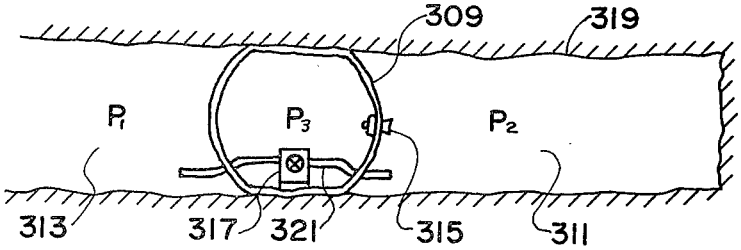

FIG. 31 is a cross sectional elevational view illustrating the use of an inflatable envelope constructed in accordance with the present invention as a barrier to control the flow of gas in a subterranean excavation.

Figure 32:
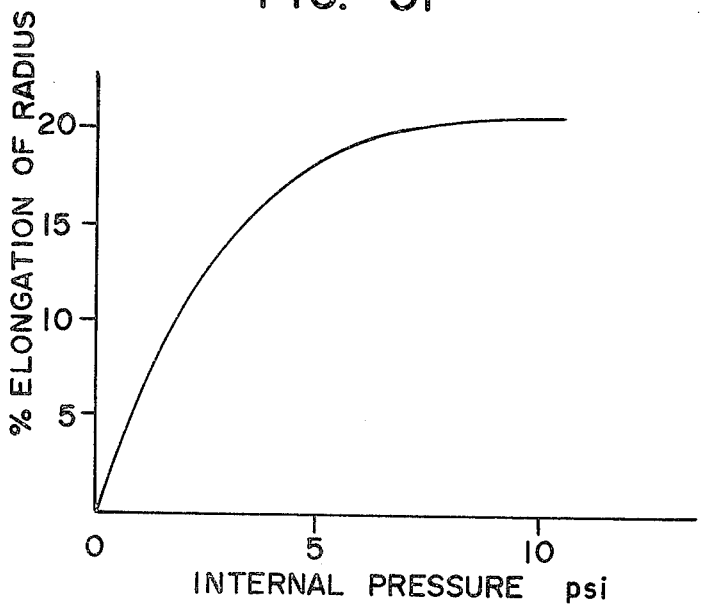

FIG. 32 is a graph depicting the elastic stretch of fabric suitable for use as an inflatable structure in accordance with the present invention as a function of internal pressure.

Figure 33:
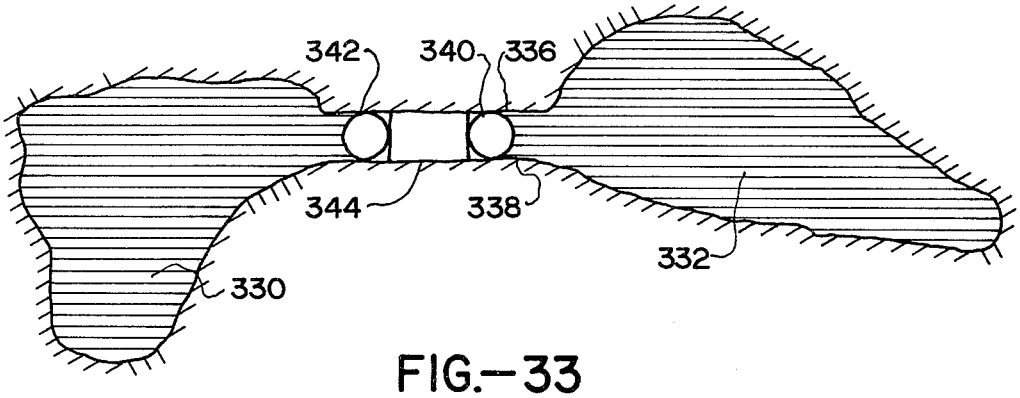

FIG. 33 is a schematic elevational view of the use of spaced tubular envelopes to form a structure passageway in accordance with the present invention.

Figure 34:
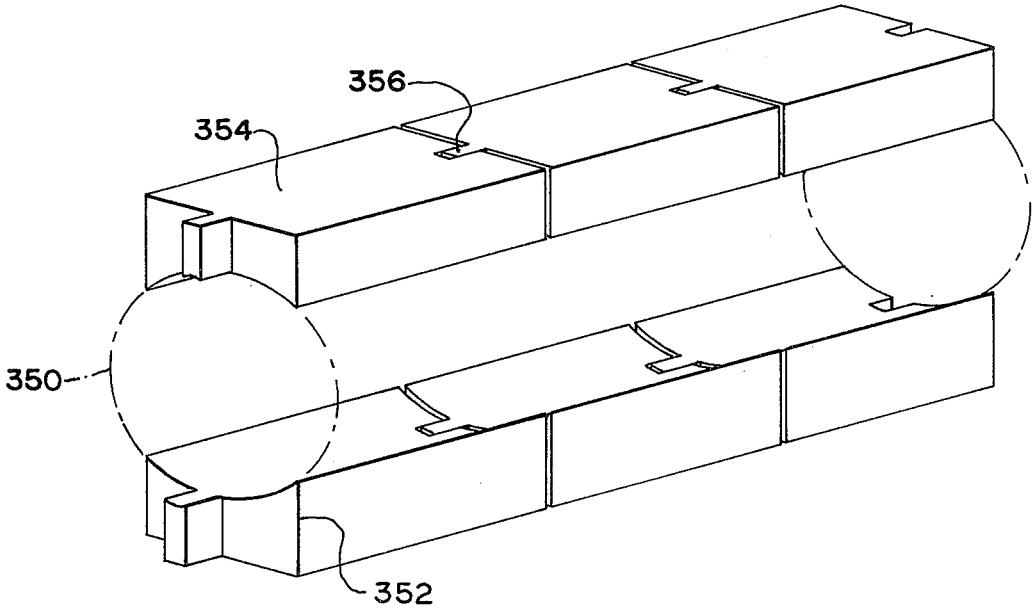

FIG. 34 is a schematic view in perspective showing an inflatable envelope apparatus employing interposed sealing means constructed in accordance with the present invention.

Figure 35:
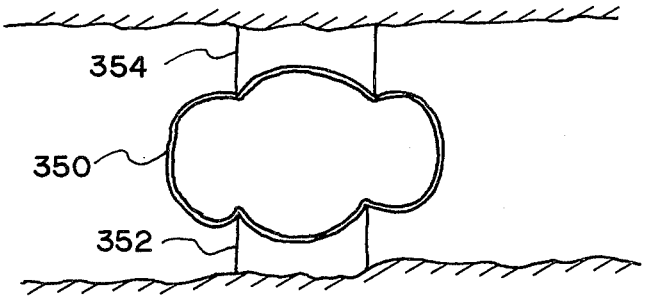

FIG. 35 is a cross-sectional view showing the sealing action and employment of FIG. 34.

DETAILED DESCRIPTION OF PRIOR ART SYSTEMS

Figure 1:
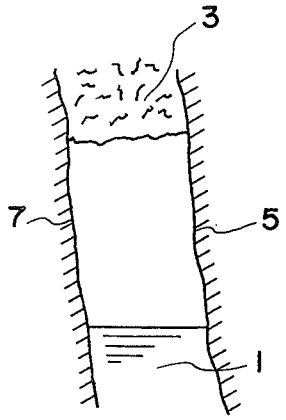

When mineral from a vein or a generally vertical ore body is extracted, backfill with tails in the remaining cavity is often attractive. Backfill material flows and seeks a horizontal surface level under the effect of gravity. The level of the upper surface of the backfill is determined by the mine operator some yards below the roof of the cavity being filled, such that, once the upper surface has dried, it serves as a floor from which operators can drill holes in the ore above, to place explosives and extract the next layer of mineral. This is shown in FIG. 1, in which dried backfill is shown as 1 and ore to be mined as shown as 3 between walls 5 and 7. When a vein or ore body is inclined at an angle, the use of backfill becomes more complicated. If the backfill is allowed to seek a horizontal level, than a large portion of the roof become unsupported, as shown by $x$ in FIG. 2. Backfill is shown as 9 and ore as 11.

Figure 2:
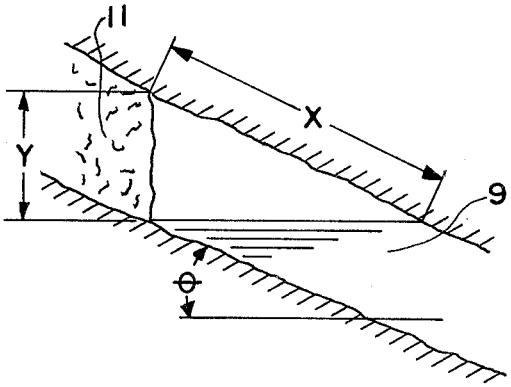
FIG. 2 is a cross sectional elevational view of conventional backfill in an inclined ore body.

It is evident that if distance Y in FIG. 2 is kept adequate for good transit and extraction of ore, the unsupported roof distance $x$ becomes increasingly large. As the angle of inclination of the vein or ore body approaches a small value, it is no longer feasible to use backfill with tails to support the roof in a horizontal excavation if a horizontal level of the fill surface is permitted. In other words, in FIG. 2 as $\theta$ approaches zero, x approaches infinity if Y is held finite.

It is comman mining practice therefore when using backfill with tails in ore bodies which are horizontal strata or have shallow angles of the order of 45° or less, to construct dams, usually out of wood, between roof and floor in order to hold the backfill away from the ore face and yet decrease unsupported length of the roof to a minimum. This is shown in FIG. 3, in which 13 illustrates a wood dam holding backfill 15 away from oreface 17 which is yet to be mined.

Figure 3:
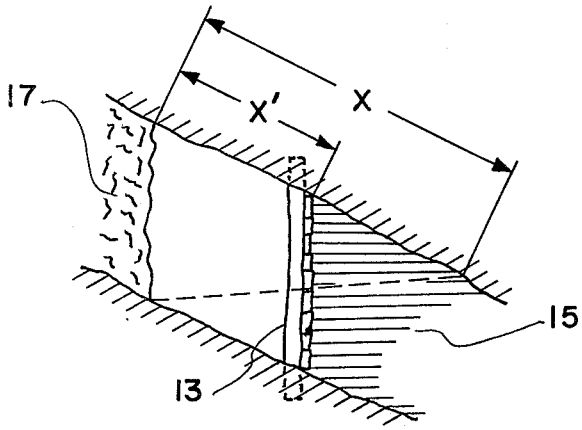
FIG. 3 is a view similar to FIG. 2 which compares the unsupported roof length in an inclined ore body with and without the use of a dam.
Figure 4:
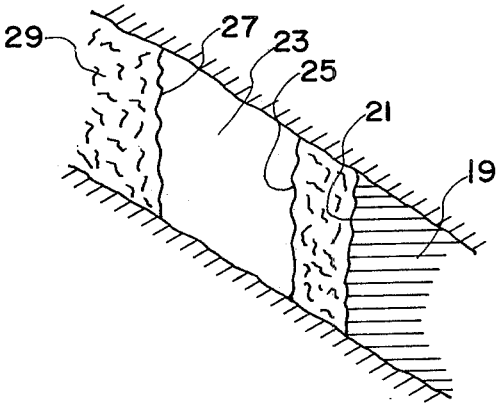
FIG. 4 is a view similar to FIG. 2 showing an alternate method of using backfill in shallow bodies.

The advantage of the dam is shown in FIG. 3 by comparing unsupported roof length $x$ without a dam, with the value of $x$ with the dam. Now, wood or other dams are costly in materials, time, labor and also use up the internal hauling and transportation systems of the mines. They can be a bottleneck to production. They are so cumberson that in some mines they are not used at all. Instead, backfill with tails is avoided altogether in favor of columns made out of mineral not extracted. Alternatively, there can be used the so-called blind backfill with tails, as shown in FIG. 4 in which the fill 19 is allowed to meet ore face 21, and a new tunnel 23 is made near the ore face facing the backfill, to permit continued extraction of the adjacent ore body by mining faces 25 and 27. Although tunnel 23 is shown horizontal, the blind backfill method can be used in inclined passages perpendicular to 23 and following ore 29.

Now the system of exploitation of FIG. 4 is also expensive since additional drilling and laterial extraction of the tunnel 23 or inclined passage is necessary. The complication is evident by comparing the system of FIG. 1 to that of FIG. 4.

A different method to employ backfill with tails, when working inclined or horizontal veins or ore bodies, consists of the use of water jets on the dried backfill, to carve out with water jets in the fill a passage for access and to permit setting up explosives and extracting ore. This is shown in three steps in FIGS. 5, 6, and 7. Backfill 31 is first applied up to ore face 33 similar to the "blind" fill of FIG. 4, but on top of a high pressure water tube 35 which has been previously placed, and which in FIG. 6 is then shown carving a passage in the dried backfill 31 by means of high-pressure water jet 37 using from a slot or nozzle 39.

Figure 6:
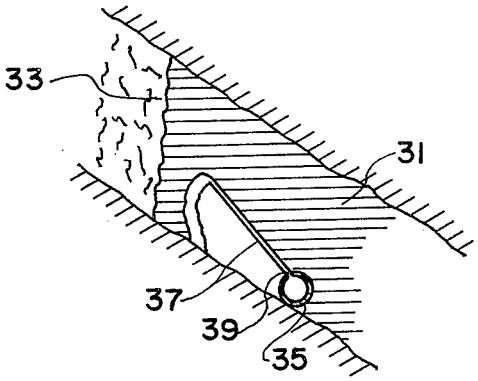

By rotating water tube 35 of FIG. 6, by angle 0 shown in FIG. 7, high pressure jets or sheets are made to carve out a complete passage in the dried backfill. The passage is shown terminated as 41 in FIG. 7.

It is, of course, feasible to use more than one high pressure tube to carve out the passage. The tubes can be used simultaneously or sequentially without rotation of tubes, as shown in FIG. 8 in which fixed tubes 43, 45 and 47 carve out a passage 49 within backfill 51 which before discharge of water 53, extended up to ore face 55. Tubes are removed and reusable after passage 49 is completed.

Figure 5:
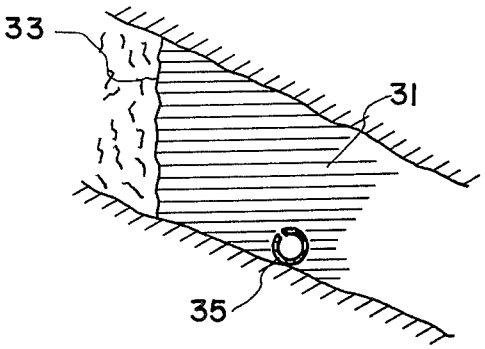

FIG. 9 shows a fixed tube 57 which performs the job of rotating tube 35 of FIGS. 5, 6, and 7 but without rotation. This is accomplished by nozzle discharges at different angles from tube 57. Each water jet carves out its own hollow hemisphere in the backfill, and as hemispheres interconnect, the passage is formed. As shown in FIG. 9, tube 57 has internal webs which define separate water conduits 59, 61 and 63. High pressure water is applied through the conduits sequentially by means of a valve. Jets 65 and 67 issue only from conduit 59. Jets 71 and 67 issued only from conduit 61, jets 73 and 75 issue only from 63. Only a short segment of tube 57 is shown. Sequential application of water pressure as shown in FIG. 10 serves to economize water pressures, and to simplify carving out of the passage by consecutive slices in the backfill, from floor towards the roof of passage.

FIG. 11 shows a carriage having several water drills which can be aimed and applied to dry hydraulic backfill, or to deposits of tailerings. Carriage 77 receives a water supply by tube 79 which pumps 81 transmits at higher pressures to manifold 83. Water drill or jets 87 are discharged from nozzles 85. Carriage is movable on wheels 89 and 93, but can be secured before discharging jets 87 by means of insertion to the ground of extendable spike 91.

FIG. 12 shows a smaller water drill structure comprising water supply hose 97, recipient 95 which may incorporate a water pump. Nozzles 99 discharge water jets 97 at high pressures. Water drill can be moved by shoulder strap 101, and secured to ground by means of spikes or tripod 103.

The use of high pressure water jets, or water sheets, is, however, costly. It requires high pressure lines. Water supply is not always available. Special hydraulic and mechanical equipment is needed. Also, it adds water to the mine, which can be a problem in some cases.

Consideration can be given to air jets or similar pneumatic means to carve out passages in dried backfill, taking advantage of availability of high pressure air for pneumatic drills in the mines. However, for obvious reasons progress would be very slow, the drain or air supply may be serious, and a critical dust problem could be created.

DETAILED DESCRIPTION OF THE PREFERRED EMBODIMENTS OF THE PRESENT INVENTION

Reference is made to FIG. 13 which shows an underground stope having upper and lower walls 105, 106 and a lateral ore face 107 forming a chamber. An inflatable envelope or airbag 107 having a generally tubular shape is disposed in the chamber and is supplied with internal gas, such as air, under pressure so that the envelope or airbag expands into contact with the upper and lower walls of the excavation and the ore face. After being so positioned a fluid-solids mixture such as a slurried backfill 109 is disposed by pumping it into the region on the lower side of the envelope, the mixture being laterally supported by the adjacent wall 110 of the airbag. Afterwards, the fluid phase of the mixture is drained, or the mixture is otherwise caused to set up into a structural body capable of giving lateral support and upward support to the roof. In a typical application, a backfill of tailings slurried with water is used as the backfill so that surface tailing ponds can be eliminated and the natural material taken from the excavation returned, thus solving the environmental problem rendering surface tailings ponds unacceptable. Furthermore, since the layout of mined areas is known the use of tailings serves as an ordering of underground space to which furture access might be had should recovery of further values from the tailings ever be deemed economic. When slurried tailings are used as backfill it is common that the water is allowed to drain away through the natural subterranean porosity and the resulting solid phase then becomes set in a relatively dry state. Subsequently, the envelope or airbag may be removed as explained hereinafter or it may be retained in place and further mining operations against the ore face can be conducted using the exposed wall of the backfill as a structural base. If the envelope is not removed, it is destroyed in the process of mining through the ore. Among the further advantages of the invention using backfill with tailings include lightness and ease of installation of the airbag which is previously collapsable so as not to create a hauling and transportation problem that it is reuseable or disposable capable of being inflated, and collapsed in a few minutes and requiring no high pressure air source. It is found that a range of 2 psi to 10 psi is adequate in many applications, and the usual air supply at the mine can therefore be used with the aid of a simple valve to reduce pressures. Furthermore, the use of inflatable expandable envelope in accordance with the present invention is relatively inexpensive. A gas tight fabric bag is all that is needed, and in certain applications even material having some porosity would be acceptable. In general, it is preferred that the material be non-expandable in the length dimension but stretchable radially so that excellent contact with the upper and lower walls of the stope can be obtained. Known elastomerically impregnated or rubberized materials possess the foregoing characteristics and are commercially available. Referring now to FIG. 14, there is shown in schematic form an illustration for procedure for recovering the airbag from within a chamber for reuse. After extraction of the ore but before the backfill is emplaced, the disposable protective carpets made of fabric or carton are unrolled as shown at 121 and 123 on the ore face and floor respectively. The envelope or airbag 125 is then unrolled adjacent to the ore wall and on top of carpet 123. The airbag is then inflated until it touches the roof 123 oreface and floor from an air supply tube 129 and through a valve 131 for controlling and lowering the pressure supplied. Just prior to the envelope touching the roof a protective carpet 135 can be positioned between the bag and the roof. Backfill 137 is then emplaced until level 139 is reached and the envelopes internal pressure can be increased as the backfill material gains height and exerts pressure on the envelope. After this the backfill is drained and dried and the chamber below the envelope is filled. At this juncture the internal pressure is reduced and if necessary, below atmospheric pressure to collapse the bag, which can then be rolled or otherwise removed in compact form and leaving an access passage as shown in FIG. 15.

With viscous fill, in which the airbag may adhere to fill, or in order to help drain of fill, special low viscosity fluid conduit 141 in FIG. 14 (air or water) may be activated after hydraulic fill is dried (or while it is drying) to aid collapse of bag. Alternatively, tube 141 can be porous to act as a drain to water content of fill 137.

If necessary, after the airbag is extracted a scraper can then be passed to set up a planar face on backfill along lines A-A of FIG. 15.

Now airbags of various types may be used to define the shape of the passage in Hydraulic fill.

FIG. 16 shows two separate air tubes 143 and 145 one next to the other, defining a vertical passage between fill 147 and ore 149.

FIG. 17 shows the use of an airbag 151 of the prolate or cross-sectional pillow shape, next to inclined ore face 153.

FIG. 18 shows the use of a special airbag 155 with an internal web 157 to support the free face before fill is applied. Web 157 can be porous or hermetic. In the latter case, sequential filling of top and bottom portion, is desirable.

FIG. 19 shows an external support 161 to the free face of the airbag by means of internal cables 159 anchored to the ore body 163 to provide adequate shape before fill is applied, and to pack fill tightly against roof 165 by tight inflation of bag 167 after fill 169 has been applied.

FIG. 20 shows airbag 171 supported by pillars 175 anchored to roof and floor at certain intervals, to fix shape before fill 173 is applied.

FIGS. 13 to 17 and other figures in this invention can be considered as cross sections in a horizontal plane as illustrating application of the airbag near or at raises when using backfill in vertical or steeply inclined body. In this application the airbag would avoid the use of a lateral dam. Also the fact that figures exhibit walls different from the ore, this is done by ways of illustration and not of limitation, as it is evident that the nature of the surrounding walls could be mineralized, i.e., containing ore.

The internal pressure of the airbag can exceed the hydrostatic pressure ot the backfill. As the latter varies with depth, deformation of the airbag need not be uniform, and shape of the airbag, its elasticity and distribution and its inflation technique can be varied to provide optimum shape of the airbag and consequent passage after the backfill is completed. For example in FIG. 18 the lower bag can be inflated at a higher pressure than the upper one if web 157 is made hermetic. This applied also to FIG. 16.

In another embodiment of my invention air pressure in the bag is varied after backfill has reached a certain level.

Pressure in the airbag can be measured with respect to the hydrostatic pressure in the backfill's fluid, and the pressure difference can then regulate the flow of air into the airbag and control its shape. This is shown in FIG. 21.

Pressure detector 177 and 179 permit valve 181 to sense pressure difference and regulate air supply from plenum 183 into airbag 185 if pressure in airbag falls below a specified margin below pressure in hydraulic backfill 187.

FIG. 22 shows how a combination of an airbag having a variable stretch distribution together with an inflation technique which makes air pressure dependent on level of backfill, can define optimum slope B-B.

Airbag 189 has two kinds of materials, portion *b* with little stretch, and portion *a* which stretches when certain valve x of internal pressure *p* is reached.

Now when hydraulic fill is below or up to level 191, pressure P is less than X and *a* lies along the dash line. Once fill reaches level 191, pressure P is raised above X such as to expand portion *a* of airbag to solid line shape 193. The fill is raised to level 195 thereby approaching very closely slope B—B as intended.

When the inflation process described for FIG. 22 is sequentially applied to an airbag of uniform stretch distribution in its entire perimeter, the resulting shape is shown in FIG. 23; airbag 197 has internal pressure P of a first magnitude when backfill is at level 199. The intermediate dash line shape 201 of airbag is attained by further increasing pressure P only after level 199 is achieved. Thereafter backfill level is raised to 203. Then pressure is further increased until final dot-line shape 205 is achieved by airbag, and thence fill material is allowed to reach level 207. Of course, gradual increase of P as hydraulic level increases can better be used instead of step increments. This process, in addition to securing a stable face to hydraulic fill after removal of airbag, also contributes to increase pressure of backfill against roof 209, rendering a useful structural function.

FIG. 24 shows a structure in which two compartments are used. The first 211 is inflated to hold shape up to level 213, the second 215 holds hydraulic fill face up to level 217.

FIG. 24 also shows a small tube 219 auxiliary to main tube 211. Tube 219 is inflated after tube 219 is inflated or simultaneously with it, but before hydraulic fill is applied. 219 can be a separate hose, or even a porous tube to aid drainage and drying of fill 213.

The system of FIG. 24 is also advantageous for the case where the axis of tube 211 is not horizontal but inclined, in which case level 213 shown will not correspond to all places in the tube. For such inclined axis cases, 211 is inflated to a pressure higher than pressure of 215, but both are inflated before fill is poured in its corresponding cavity.

When mining underground layers of great thickness, for example 8 yards, it may be easier to assemble inside the mine air tubes out of rolled air tight fabric. For such dimensions and purposes the fabric's edges may be united inside the mine lengthwise by men operating from eithin or from outside the tube's fabric, by use of special clamps. Internal clamps simplify the use of internal tensors or cables to regulate shape of airbags. A detailed vier of typical calmp is shown in FIG. 26.

The complete tubes of FIG. 25 are shown in FIG. 26. In FIG. 25 arms 245 and 247 hold between them edges of fabrics 241 and 243 hermetically sealed with aid of longerons or structural bars 249. Arms are tightened by screw 251. Clamp is secured internally in the bag by cable 253.

A solution of interest for an inclined strata of great depth is shown in FIG. 27, in which airbag 259 can actually be allowed to float to upper left corner next to ore 255 and roof to define a large passage capable of housing a truck 263. Fill 257 is placed forcing tube 259 to upper left corner in drawing. Some ore ramps 261 remain unremoved for simplicity.

FIG. 28 shows the use of air filled envelopes for the extraction of dry pulp in a chamber. Here the passages inside the airbag are used to secure access to remote protions of the chamber, and to gradually evacuate the dry pulp by adding then high pressure fluids. This normally requires that the airbag be placed in position before the pulp material is applied. The pulp is allowed to dry on top of the airbag. Then when removal is desired, water drills and pumps are introduced into airbags to remove dried pulp by adding the adequate solvent and pumping the newly formed fluid out through the channels formed by the airbag. This embodiment is therefore applicable to new deposits of tailings below which there is pre-set a channel system of airbags, which will serve to easily move the tailings in the future. Another application is for the extraction of dry mineral fluids used in ship transportation.

FIG. 28 shows the limits of a chamber 263 such as in a ship, but could be the limits of a mining chamber for tailings or the cargo volume of a truck, at the bottom of which there is placed air tubes 267 near the horizontal and 269 near the vertical. Liquid with minerals or concentrates 265 is applied and allow to firm up. When ship arrives to port, water guns or water drills 271 such as for example FIGS. 12 or 11, which may be introduced or preferrably pre-installed, operate through the fabric of the airbag, or after the removal of the aribag, to dissolve the dry substances which flow as 279 and are evaculated by means of pump 275 and ejection tube 277. More than one water drill, such as 273 may be used sequentially or simultaneously.

FIG. 29 shows an airbag 281 which is attached at its bottom to a vessel's chamber 295 which here exemplifies a railroad car, but could be the bottom of a ship, and inflated before fluid material 285 is poured. Bag 281 is placed approximately concentric with extractor tube 283 having a pump 293 to pump upwards through 291 the water 289 which generates fluid substances 297 which fall inwards through the passage (vertical) defined by airbag 281. Water jets 289 can be fired from a rotating gun 287 which can descend on a screw on the outer walls of 283. Water jets or other fluid jets can actually pierce through fabric of airbag 281, or airbag can be removed before operation of water jet. As an alternate to pump 293, bottom of vessel can have a valve to evacuate fluid 297 by gravity, such as valve 296.

FIG. 30 has a similar extractor tube to that of FIG. 31, but airbag is seen capable of being closed at top. Here water gun carriage 299 generates a cavity at the bottom of which has a fluid 301 formed by water jets against dried up substance 303, and is pumped out of vessel 305 by a pump at the bottom of extractor tube 307. Pressure inside cavity and tube 297 can be kept high to aid in the support of the roof of the cavity and aid in its gradual dissolution, as well as to act in aid, or in place of pump 308.

An important feature of the embodiment of FIGS. 29 and 30 is the rapid action of water jets acting from within the passage formed by airbags. Obviously the walls of the passage must sustain considerable lateral pressure, specially near the bottom of vessel, and I make them of a light material which can be either removed or pierced or destroyed by the water jets if necessary. A light material can be used when internal pressure P are held high until the fluid material 285 and 303 has dried.

Also, preformed vertical passage formed by airbags, or equivalent structures, help to provide a center core from which action of water jets can irradiate. In FIG. 31 the flow of water is across material 285 and dissolved pulp flows through the vertical passage formed by the airbag.

FIG. 31 shows the use of an airbag 309 to provide a separation between regions 311 and 313 having different pressures $P_2$ and $P_1$, both of which must be less than pressure $P_3$ inside airbag. Pressure $P_2$ can be controlled and increased by means of flow from $P_3$ to $P_2$ through valve 315. The purpose of raising pressure $P_2$ can be to support roof 319. For example $P_1$ could be atmospheric, $P_3$ four atmospheres, and $P_2$ three atmospheres. Auxiliary flow between $P_1$ and $P_2$ can be accomplished by communicating tube 321 having a valve, or an air pump 317.

FIG. 32 shows the elastic properties I have defined on a fabric I have developed to construct inflatable stretchable airbags. Elongation is plotted as a function of internal pressures. A stretchable fabric was covered with rubber. Very slow air leaks under pressure. Would require a permanent air supply to hold internal pressure consistant while pulp is drying.

I have shown how to apply by airbag or air tube for backfilling chambers or stopes with tails or similar substances in horizontal and inclined orebodies. I have also shown its application on transportation systems such as loading chambers in ships and railroad cars. The airbag also applies to control of fluids in general in undergroudn works, for example to channel water in certain directions; or to isolate poisonous gasses by means of airbag barriers, or to aid in ventilation by dividing underground passages wherein the airbag acts as a dividing compartment; or to act as supporting barrier to increase pressures on one side of the airbag.

Referring to FIG. 33, there is shown a system for forming an isolated access tunnel through a series of excavation chambers, two of which are shows at 330, 332. Generally the excavation chambers are interconnected by a tunnel portion 334 having substantially parallel, opposed walls 336, 338. A first elongate tubular envelope 340 as disclosed herein is disposed within the tunnel portion and is inflated by suitable means so as to contact the opposed wall surfaces. A second elongate tubular envelope 342 which may be identical in construction to the first is positioned in spaced apart relationship from the first envelope and is supplied with suitable means for inflating the same into contact with the opposed walls of the tunnel to thereby cooperate with the first envelope to form an access passage 344. After formation of the tunnel the remaining portions of the lateral excavation in chambers 330, 332 can be filled with backfill as hereinbefore described. In general this system permits continuous progressive mining in which various ore bodies are interconnected by a tunnel or shaft and after mining of each body it is backfilled and the next ore body is mined in turn.

Referring to FIGS. 34 and 35, there is shown an arrangement whereby the unevenness of typical opposed walls in an excavation site may be accommodated so as to form a better seal between the inflatable member and the walls. For this purpose an elongate tubular envelope 350 is provided and rests in shaped elongate deformable shell means 352,354 disposed between the envelope and each adjacent wall. The envelope is inflated to thereby partially crush the deformable means between the envelope and the wall, the deformable means conforming to the unevenness to form a seal therewith. Typically such deformable structure can be made of plastic foam products shaped as in block form with alignment lugs 356 to form a continuous elongate structure. A typical plastic is rigid foam polystyrene. FIG. 35 shows that when suitably shaped with a slight concavity to accept tubular structure that the edges of the deformable means also deform the inflatable envelope as well as being deformed thereby and by the unevenness of the walls. Accordingly, an excellent seal is created both between the envelope and the deformable means and between the ladder and the adjacent uneven wall.

I claim:

1. A method for extracting substances containing mineral values from a region which defines a mineralized face adjacent a chamber in an excavation site, comprising the steps of disposing an inflatable envelope within said chamber with a first side of the envelope contiguous to said face, inflating said envelope with a charge of fluid under pressure, disposing fluid substance containing a mixture of liquid and solids into the chamber contiguous to a second side of said envelope whereby said fluid substance exercises an external pressure on said envelope which is transmitted at least partially by the pressure of the fluid charge within the envelope to be resisted by said face, said fluid substance being at least partially drained to become solidified within said chamber and substantially outside said envelope whereby the boundary of said solidified fluid substance is substantially defined by said second side of the envelope and whereby an accessway is defined between said mineralized face and said solidified fluid substance.

2. A method as in claim 1 wherein said substance containing mineral values forms a layer adjacent to said envelope and further including the step of mining said substances containing mineral values from within said passageway after said fluidized substance has solidified.

3. A method as in claim 2 in which said fluid substance comprises a slurry of tailings from mining operations mixed with water.

4. A method as in claim 1 further including the step of mining the material adjacent the envelope after the fluid substance has set.

5. A method as in claim 4 further including the steps of collapsing and removing the envelope before proceeding with the mining step.

6. A method as in claim 1 and further characterized in that said region has a portion which defines an ore body, said envelope is inflated by injecting a charge of gas under pressure into the envelope, and said fluid substance comprises tailings.

7. A method of mining mineral values from an excavation having a mineralized face, comprising the steps of disposing an inflatable envelope within said excavation adjacent said face, inflating said envelope with a charge of fluid under pressure whereby one side of the envelope is contiguous to said face, disposing a settable mixture of solids and liquid within said excavation contiguous to a side of said envelope which is substantially opposite said first side whereby the pressure of the settable mixture is resisted by the pressure of the fluid charge within the envelope and transmitted to be resisted at least partially by the mineralized face, setting said mixture whereby an accessway is defined between the boundary of the set mixture and the mineralized face, deflating said envelope, removing said envelope from the accessway, and removing mineral values from said mineralized face through the accessway whereby the excavation is enlarged and a second mineralized face is thereby formed spaced from the boundary of said set mixture.

8. The method of mining which comprises:

a. removing a portion of a body of ore leaving an open volume communicating with an exposed face of ore;

b. placing space occupying means in one portion of said open volume contiguous to said exposed face;

c. filling at least another portion of said volume from which ore has been removed with a solidifiable material wherein said solidifiable material exerts a pressure on said space occupying means which is transmitted at least partially by said space occupying means to be resisted by said face;

d. removing ore from said exposed face through work operations conducted within said one portion of said open volume.

9. The method of claim 8 in which said space occupying means comprise a container adapted to be injected with fluid.

10. The method of claim 9 in which said solidifiable material includes particles from tailings which have been generated from a concentration plant treating ore.

11. The method of claim 10 in which said solidifiable material includes a cementing substance.

12. The method of claim 9 in which fluid is withdrawn from said container and said work operations for removing ore are conducted across said container.

13. The method of claim 8 in which the removal of said ore from said space is accomplished utilizing vehicles driven within said one portion of said open volume

14. The method of claim 8 in which said work operations include the use of hydraulic mining means.

15. The method of claim 8 in which said space occupying means comprise a flexible container adapted to be injected with a gas-containing substance.

16. The method of claim 8 in which said space occupying means comprise two elongated inflatable containers extending one in contact with the other adjacent to said face.

17. The method of claim 8 in which said space occupying means comprises an inflatable flexible container which is adapted to be placed adjacent said ore face with a separate protective lining material between said container and the surrounding surfaces adjacent said container.

18. The method of claim 8 in which said space occupying means is elongated and has a long dimension, with tubular draining means provided approximately parallel to said long dimension along external surface portions of said space occupying means.

19. The method of claim 8 in which said solidifiable material comprises a mixture of solids and liquids and said space-occupying means comprises a flexible inflatable fluid container, and in that after said filling material has reached a first level, the pressure of the fluid in said container is increased to modify the shape of said container above said first level, and thereafter additional filling material is added to a level above said first level.

20. A method for mining and filling in which safety of personnel is attained by virtue of the disposition in each of its steps comprising:

a. removing a portion of a body of ore leaving an open volume enclosed with surfaces communicating with an exposed face of ore, said volume having a distance approximately perpendicular to said face of ore;

b. placing space occupying means in one portion of said open volume contiguous to said exposed face, occupying a portion of said distance;

c. withdrawing all personnel from said one portion of said open volume;

d. filling another portion of said volume with a mixture of liquid and solid material to occupy the remaining portion of said distance, whereby said material plus said space occupying means extend substantially completely across said distance;

e. said solidifiable material being characterized in exerting fluid pressures against said space occupying means and being adapted to drain off its liquid content and solidify, thereby ceasing to exert said fluid pressures;

f. after said material has solidified, moving said space occupying means and occupying said one portion of said open volume with personnel for the removal of said ore from said body.

21. The method of mining and filling in approximately horizontal ore cuts in which work is conducted within the space existing between the opposite faces of an ore formation being extracted and the face of a solidified backfill material, characterized in having a roof distance between said ore and backfill faces compatible with the strength of said roof, comprising the cyclic steps of:

a. removing a cut of ore from an ore formation leaving an open volume limited in one side by an exposed face of ore and in an opposite side by said face of backfill material, with a roof extending between said faces;

b. placing space occupying means in one portion of said open volume contiguous to said exposed face of ore;

c. filling the remaining portion of said open volume from which ore has been removed with a solidifiable material contiguous to said space occupying means with said space occupying means and said solidifiable material extending substantially completely between said solidified face and said face of ore, with said roof distance extending between said solidified face and said ore face, being of a dimension limited to be no greater than the width of said solidifiable material plus the width of said space occupying means;

d. moving said space occupying means thereby creating a passageway in said one portion of said open volume;

e. removing another cut of ore through said passageway to define a second open volume, and continue the cyclic mining and filling steps described above.

22. The method of claim 21 in which said occupying means comprise a container having an expandable volume adapted to be expanded by introducing a fluid into the container.

23. The method of claim 21 in which said step of filling said open volume is accomplished by a substance including particles which have issued from the tailings of a concentration plant treating ore.

24. The method of mining and filling in operations conducted in a plane which is inclined at a large angle to the vertical utilizing a low pressure inflatable elongated container which comprises the steps of:

a. removing a portion of a body of ore along said plane leaving an open volume communicating with an exposed face of ore;

b. placing said container in one portion of said open volume adjacent to said exposed face;

c. inflating said container to a low internal pressure no greater than approximately 3 pounds per square inch;

d. filling at least a substantial portion of the remaining said open volume from which ore has been removed with a solidifiable material extending in said remaining volume and contiguous to said space occupying means;

e. deflating said container after said solidifiable material has solidified thereby defining an accessway within said one portion of said open colume;

f. said solidifiable material exerting pressures on said container which are transmitted by said container to be resisted at least partially by surfaces external to said container and acting on three sides of said container;

g. removing ore from said face along said accessway.

25. The method of claim 24 in which after the filling material has reached a first level external to said container, the pressure in said container is increased to increase the volume of said container above said level, and thereafter additional filling material is added to raise its level above said first level.

* * * * *